United States Patent [19]

Thornton et al.

[11] 4,415,873

[45] Nov. 15, 1983

[54] VARIABLE INDUCTOR HAVING REDUCED ARCING TENDENCY

[75] Inventors: Jack C. Thornton, Satellite Beach, Fla.; Randy G. Russell, Arlington Heights, Ill.

[73] Assignee: Rockwell International Corporation, El Segundo, Calif.

[21] Appl. No.: 364,292

[22] Filed: Apr. 1, 1982

[51] Int. Cl.[3] ..... H01F 29/06

[52] U.S. Cl. ..... 336/139; 336/141; 336/149

[58] Field of Search ..... 336/139, 141, 149

[56] References Cited

U.S. PATENT DOCUMENTS 4,064,474 12/1977 Adams et al. ..... 336/139

*Primary Examiner*—A. T. Grimley
*Assistant Examiner*—Susan Steward
*Attorney, Agent, or Firm*—Terry M. Blackwood; Howard R. Greenberg; H. Fredrick Hamann

[57] ABSTRACT

A variable inductance includes a coil and a moveable contactor which maintains continuous contact with the coil. An electrical connection, which is moveable along with the moveable contactor and away from a first end of the coil, connects the moveable contactor with further contact means positioned remote from the first end of the coil.

5 Claims, 4 Drawing Figures

VARIABLE INDUCTOR HAVING REDUCED ARCING TENDENCY

The present invention is generally related to variable inductance apparatus and more specifically to radio frequency or other high voltage tuneable coils.

One common variable inductance coil is the conventional and well-known roller or rotary coil. The roller coil comprises an electrical coil or solenoid plus a conductive roller or trolley wheel contactor supported on an electrically conductive guide or bar which runs the entire length of the coil. Since the guide or bar is electrically connected to one end of the used portion of the coil, the voltage across the used portion of the coil is limited to the breakdown voltage of the gap between the high voltage end of the used coil portion and the conductive guide or bar.

In accordance with the present invention, this problem is addressed and resolved by apparatus which provides an electrical connection which is moveable along with a moveable contactor.

These and other features, objects, and advantages of the invention will become more apparent upon reference to the following specification, claims, and appended drawings in which:

Figure 1:
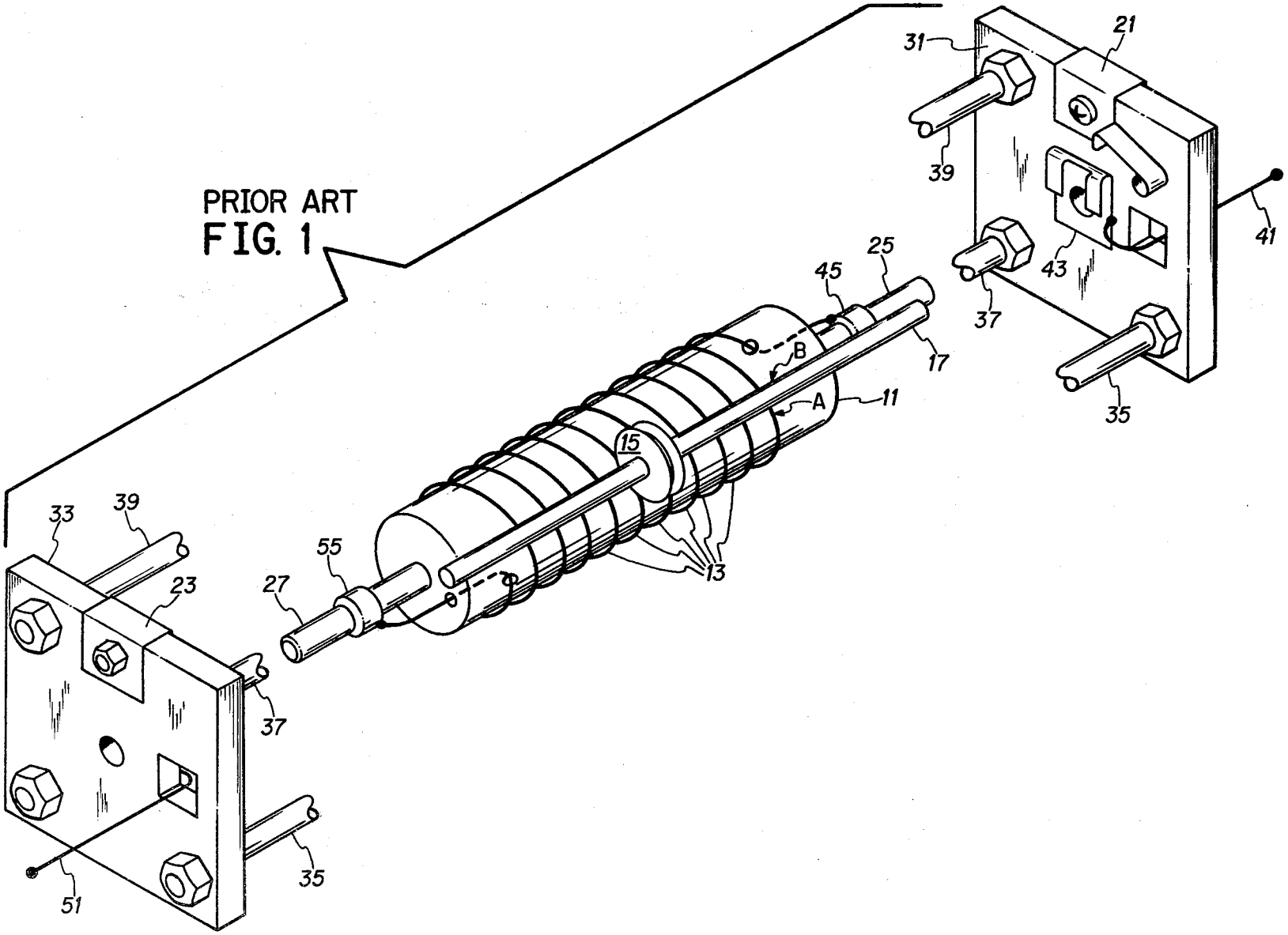
PRIOR ART FIG. 1
FIG. 1 is an exploded perspective view of a prior art roller coil.

Turning now to FIG. 1, the conventional and familiar roller coil represented therein comprises a non-conductive cylindrical form 11 bearing a coil 13 of substantially helically wound bare conductive wire, and further comprises a trolley wheel contactor 15 carried by conductive guide 17. Trolley wheel contactor 15 is grooved or curved around its circumference so as to mate with or receive the coil wire. Guide 17 is held substantially parallel to the side of the coil by conductive spring-suspension mounts 21 and 23 which also serve as electrical terminals. Axially located shafts 25 and 27 protruding from the two form ends are journaled through openings in non-conductive end plates 31 and 33. Rods 35, 37 and 39 secure end plates 31 and 33 together and the secured plates hold the form and coil and allow rotation of the coil about its central axis.

Electrical connection or access to the far end of the coil is via electrical wire or terminal 41, brush 43, and slip ring 45. Electrical connection or access to the near end of the coil is via electrical terminal 51, brush 53 (not shown), and slip ring 55. Electrical connection or access to the roller/trolley wheel 15 and the point of the coil it touches is via either of mount-terminals 21 or 23, and via guide bar 17.

Trolley wheel 15 is free to turn about guide 17 and is also free to slide therealong. As the coil is rotated about its axis, the coil acts like a worm or screw and drives the wheel 15 along the guide 17. Thus, a variable inductance is available between either end of the coil and the trolley wheel contactor.

The arcing possibility briefly mentioned hereinabove can arise in the following manner. Assume that terminal

41 (and thus the far end of the coil) is connected to high voltage RF and that the roller/trolley wheel 15 is the low voltage side of the used portion of the coil. As the coil is tuned such that the trolley wheel moves toward the near end, then the voltage differential between the ends of the used coil portion (i.e., between the coil far end and the wheel) increases. Since the guide 17 is at the same potential as the wheel 15, the entire voltage differential appears across the air gap existing between the far end of guide 17 and the coil wire directly underneath. That is, at location A on the coil, the magnitude of the voltage is high and at location B on the guide, the magnitude of the voltage is low. If the voltage between ends of the used coil portion becomes too great, the potential difference between locations A and B can exceed the breakdown voltage of the gap between locations A and B, and arcing occurs.

Figure 2:
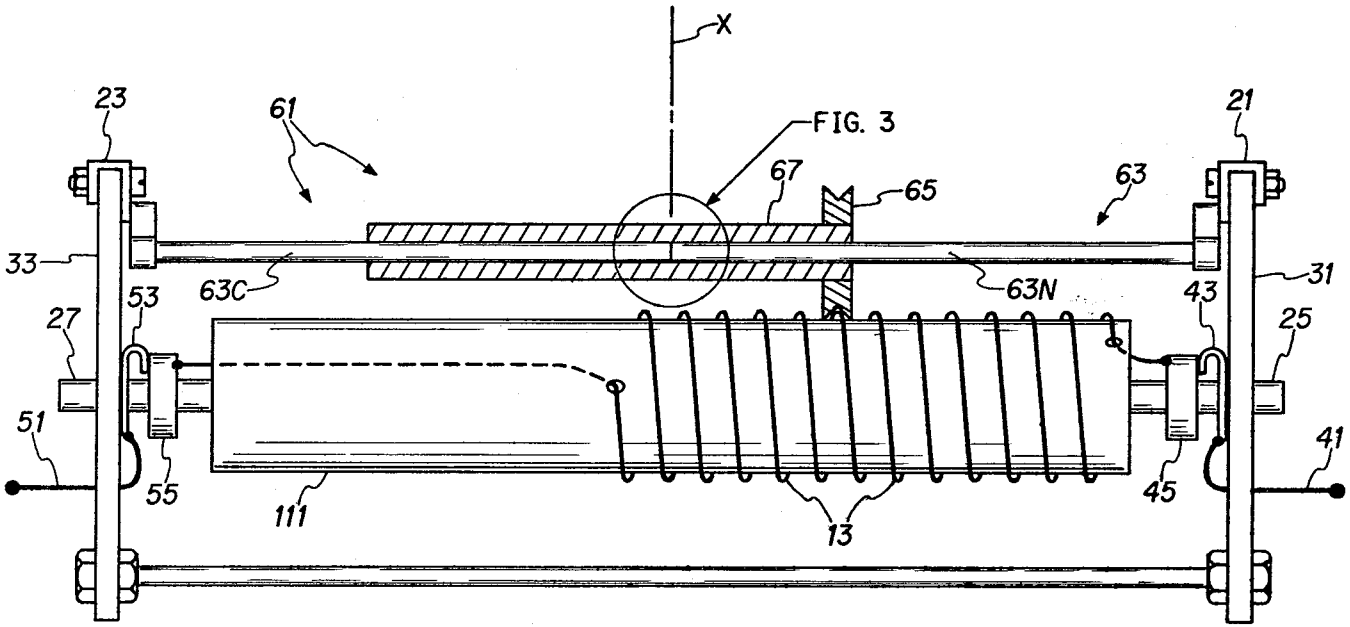
FIG. 2 is a side, partly sectional, view representing variable inductor apparatus incorporating the principles of the present invention.

Turning now to FIG. 2, there is represented apparatus for overcoming the aforedescribed problem. The FIG. 2 variable inductance apparatus is substantially the same as that represented in FIG. 1 with the exception of the FIG. 2 subassembly 61 comprising the guide 63, roller 65 and sleeve 67, and with the exception that coil 13 does not cover the entire length of elongated form 111. Liked esignators are employed for like elements in the two figures.

Figure 3:
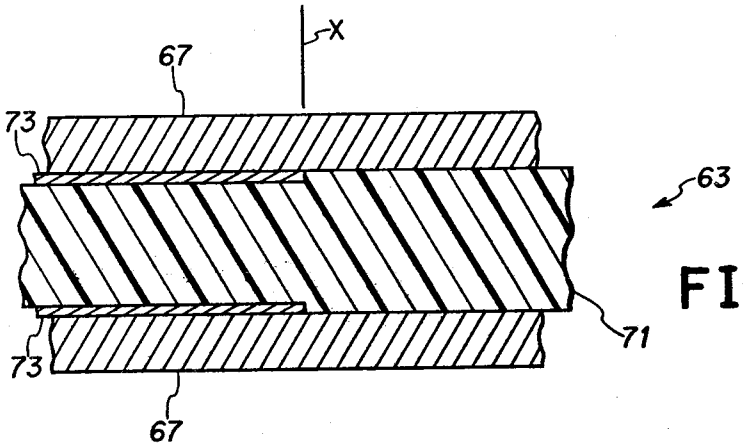
FIG. 3 is a magnified side sectional view representing an indicated part of the FIG. 2 apparatus.

More particularly, wheel guide 63 in FIG. 2 comprises a cylindrical rod which is conductive over approximately half its length and is non-conductive over the balance of its length. That is, guide 63 comprises two portions 63C and 63N. The portion of the guide 63 to the left of line X, namely, guide portion 63C, is conductive, and the portion of the guide 63 to the right of line X, namely, guide portion 63N, is non-conductive. As indicated in FIG. 3, the guide 63 may comprise a non-conductive rod 71 bearing a metal clad 73 over approximately half its length. Returning to FIG. 2, guide 63 is held substantially parallel to the side of coil 13 by appropriate means such as the FIG. 1 type of mounts 21 and 23.

Carried by the guide 63 is a conductive roller or trolley wheel 65 and conductive sleeve 67. Conductive sleeve 67 is electrically conductive along its entire inner surface and moreover is slideable along guide 63 and may also be rotatable therearound. Roller or trolley wheel 65 is electrically and mechanically connected to sleeve 67. Roller 65 can be rotatable or non-rotatable relative to sleeve 67, and also relative to guide 63, but is preferably rotatable relative to guide 63 so as to afford either of rotating or sliding contact with coil 13. Roller 65 is grooved about its circumference similarly to the wheel 15 of FIG. 1. Due to the various electrical contacts from wheel 65 to sleeve 67 to guide portion 63C to mount 23, there is electrical continuity between wheel 65 and mount 23.

As the coil is rotated it acts like a worm or screw to simultaneously drive wheel 65 and sleeve 67 along the path of the guide 63 substantially parallel to the side of the coil 13. Electrical contact is maintained between sleeve 67 and conductive guide portion 63C as the wheel and sleeve travel. As wheel 65 travels along its path, it continuously electrically contacts the multi-turn coil 13 and contacts only one turn at a time. As illustrated in FIG. 2, wheel 65 is narrow enough such that it will not simultaneously contact two adjacent coil turns. Wheel 65 serves as a moveable contactor, conductive guide portion 63C serves as an electrical contact positioned remote from the right-hand coil end, and sleve 67 serves as a moveable connecting means electrically interconnecting the wheel 65 and guide portion 63C.

It should be apparent that the FIG. 2 apparatus resolves the abovedescribed arcing problem associated with the prior art. More particularly, using the same example earlier posed, assume that terminal 41 (and thus the right-hand end of coil 13) is connected to high voltage RF, and that the wheel 65 is the low voltage side of the used coil portion. In the tuning condition illustrated in FIG. 2, the voltage differential between wheel 65 and the right-hand coil end may be substantial. However, as seen from FIG. 2, the part of the guide 63 located near the high voltage coil end is not conductive and thus is not electrically connected to the low voltage potential. The points which do share the low voltage potential are not located near the high voltage coil end. Since there is no low-voltage point spatially located near the high voltage end of the coil, the arcing problem associated with the prior art embodiment is overcome.

Figure 4:
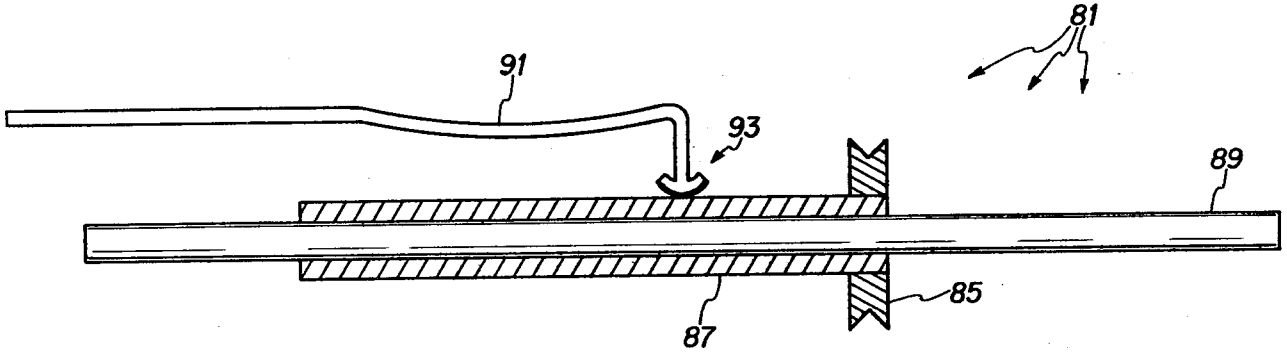
FIG. 4 is a side, partly sectional view representing alternative apparatus also in accordance with the present invention.

FIG. 4 shows a subassembly 81 which may be substituted for the subassembly 61 of FIG. 2. The FIG. 4 wheel 85 and sleeve 87 are very much like the wheel 65 and sleeve 67 of FIG. 2. FIG. 4 guide 89 is also a cylindrical rod but is non-conductive over its entire length. Serving in place of the FIG. 2 conductive guide portion is (i) a conductive extension 91 attachable to mount-terminal 23 and (ii) a brush-type electrical pick-up 93 for slidably electrically contacting sleeve 87.

Other possible alternatives include coils which follow a helical path whose pitch is variable instead of constant and/or helical coils wound around a truncated cone form instead of a cylindrical form. In such cases, the wheel would still follow a guide parallel to the side of the winding.

Thus, while various embodiments of the present invention have been shown and/or dscribed, it is apparent that changes and modifications may be made therein without departing from the invention in its broader aspects. The aim of the appended claims, therefore, is to cover all such changes and modifications as fall within the true spirit and scope of the invention.

What is claimed is:

1. A variable inductor comprising:

a coil comprising multiple turns of electrical conductor wound to substantially follow a helical path, said coil being rotatable and having first and second ends;

a moveable, electrically conductive, contactor first means, located exteriorly of said coil, for continuously electrically contacting said coil one turn at a time and for traveling along a path substantially parallel to the side of the coil as the coil is rotated;

guide second means for guiding said first means along the first means path of travel, said second means being stationary, being elongated, and being oriented substantially parallel to the side of the coil, said second means having a first portion located in the vicinity of the first end, and having a second portion located in the vicinity of the second end, said second means also being at least partly non-conductive so that, when the first means is located in the vicinity of the second end, the second portion is electrically isolated from the first portion;

voltage access station third means, located further from the first end than the second end, for sharing any voltage potential present on said first means and for providing access to any voltage potential present on said first means, said third means being stationary, being electrically conductive, being suitable for being electrically connected to said first means, and being located and configured such that, when the first means is located in the vicinity of the second end, said third means is electrically isolated from the second means first portion;

moveable electrical connection fourth means for electrically interconnecting the moveable first means to the stationary third means, said forth means being mechanically coupled to said first means so as to move simultaneously therewith and so that as the first means travels away from the first end said fourth means also moves away from the first end, said first, second, third, and fourth means cooperating such that, when said first means has thereon a voltage potential $V_1$, the spatial location of $V_1$ moves away from said first end as said first means moves away from said first end.

2. A variable inductor as defined in claim 1 wherein said first means and said fourth means both move along a path substantially parallel to the side of said coil as the coil is rotated.

3. A variable inductor as defined in claim 1 or 2 wherein said first means is driven along its path of travel by the coil as the coil rotates, whereby said coil serves substantially as a mechanical worm.

4. A variable inductor as defined in claim 3 wherein said first means comprises a wheel grooved around its circumference so as to be suitable for receiving and riding along the electrical conductor of the coil.

5. A variable inductor as defined in claim 1 wherein said second means has a conductive portion in the vicinity of the second end, and said third means is appropriately configured to serve as said conductive portion.

* * * * *